US006581227B1

(12) United States Patent
Obermaier

(10) Patent No.: US 6,581,227 B1
(45) Date of Patent: Jun. 24, 2003

(54) HOLLOW BODY FOR USE AS A SITTING SUPPORT

(75) Inventor: Toni Obermaier, Prien-Bachham (DE)

(73) Assignee: Gebr. Obemaier OHG, Prien-Bachham (DE)

( * ) Notice: Subject to any disclaimer, the term of this patent is extended or adjusted under 35 U.S.C. 154(b) by 0 days.

(21) Appl. No.: 10/150,951

(22) Filed: May 21, 2002

(30) Foreign Application Priority Data

Mar. 4, 2002 (DE) ..... 202 03 457 U

(51) Int. Cl.[7] ..... A47C 20/02
(52) U.S. Cl. ..... 5/654; 5/653; 5/925; 5/944
(58) Field of Search ..... 5/653, 654, 925, 5/944

(56) References Cited

U.S. PATENT DOCUMENTS 679,915 A * 8/1901 Rudolf ..... 5/653
1,468,072 A * 9/1923 Ogle ..... 128/889
2,156,629 A * 5/1939 Hutchison ..... 297/452.25
3,276,047 A * 10/1966 Emery ..... 5/654
4,405,129 A * 9/1983 Stuckey ..... 482/112
4,592,589 A * 6/1986 Hellwig ..... 297/452.41
5,402,545 A * 4/1995 Jolley ..... 5/653

FOREIGN PATENT DOCUMENTS

| | | | |
|---|---|---|---|
| DK | 29718922 | 9/1998 | ..... A47C/3/16 |
| DK | 29804217 | 9/1998 | ..... A47C/3/16 |
| EP | 0448336 A1 * | 9/1991 | |
| WO | 0025719 | 5/2000 | |

* cited by examiner

*Primary Examiner*—Michael F. Trettel
(74) *Attorney, Agent, or Firm*—Antonelli, Terry, Stout & Kraus, LLP

(57) ABSTRACT

A hollow body is configured for use as a sitting support. A sitting area has at least two portions spaced from each other. At least one integral flat groove or recess is formed between the portions. The portions are interconnected by at least one connecting web extending between said portions.

25 Claims, 8 Drawing Sheets section B-B section B-B section B'-B' section B'-B' section B'-B'

HOLLOW BODY FOR USE AS A SITTING SUPPORT

FIELD OF THE INVENTION

The present invention relates to a hollow body for use as a seat or sitting support. Particularly, the present invention relates preferably to a hollow body having an especially designed sitting area.

BACKGROUND

Usually, seats have a flat sitting area which is elastically distorted by the load due to the weight of a person. Thereby, the sitting area adaptingly fits to the parts of the body being in contact therewith. Commonly, these are body parts of the backside, parts of the thigh and the pelvis bottom. The pressure resulting from the body weight is received by the resting parts of the body and leads to compressions and distortions thereof. A pressure load of the resting parts of the backside and of the thigh are received by their muscles, which can durably stand this load without any problems. It is a different situation, however, in case of diseases of the prostate or also in the presence of haemorrhoids. Pressure loads in the area of the pelvis bottom are passed on to the internally placed prostrate and thereby can result in undesired additional irritations. Centrally located pressure loads of the pelvis bottom can also take effect on the haemorrhoids and result also in an undesired irritation or pain.

BRIEF SUMMARY

Therefore, it is an object of the preferred embodiments to provide a hollow body for the use as a seat or seat support having a design which at least reduces the pressure loads affecting the pelvis bottom, wherein the pressure load is distributed among and concentrated onto parts of the body which have higher physical resilience. The seat shall further provide a stable sitting area support for users.

The hollow body according to the preferred embodiments has at least two sectional portions destined for receiving parts of the backside of the user, by which a total support is achieved. Between the portions there is formed a deepening or recess relative to the height of the sitting area or even a through hole or through-cut, respectively, which as it is depressed prevents the contact with the aforementioned parts of the body to be taken care of. Between the portions there is a connecting web which ensure the joining of the portions.

The connecting web may be designed arbitrarily, preferably in one-piece or integrated with the portions. It may be fitted such that overall a U-like shaped, horseshoe-like shaped, ring-like shaped, tire-like shaped structure and sitting area is formed, in which adjoining integral parts form the portions and the connecting web. With that, both legs of the horseshoe or U-like shape form the portions, whereas the bent intermediate part between the legs forms the connecting web. In case of a tire-like shape both the portions and the connecting web are shaped in a bent way.

Preferably, the deepening, recess or through hole or through-cut are opened outwardly, respectively, since the corresponding parts of the body, e.g. the prostate are also arranged outside. This results in a pelvis-like recess or deepening or hole, respectively, which is accessible from outside or which is opened outwardly, respectively.

DESCRIPTION OF PREFERRED EMBODIMENT

Preferably, the skin of the hollow body is at least partially made of a thermoplastic polymer, e.g. PE, HD-PE, ABS, PA, PVC or PES, preferably treated with plasticizer and the common additives.

Preferably, the middle axes of the portions form an angle with each other, but alternatively may also be parallel. The shape of the portions is flat and rounded or straightened at its periphery, but otherwise arbitrary.

Preferably, the sitting area of the hollow body is U-like shaped, horseshoe-like shaped, ring-like shaped or tire-like shaped (with interruption). The e.g. U-like shaped sitting area ensures that the pelvis bottom of the user, who may come centrally into contact with a seat, is effected by less or by no pressure load. The legs of the sitting area support the thighs of a seating person, whereas parts of the backside are arranged over a centrally cut out area (deepening or recess) of the e.g. U-like shaped sitting area. The resilience of the hollow body results in an ergonomic fitting of the sitting area to the anatomy of the resting parts of the body.

More preferably, the hollow body fits to the anatomy of the parts of the body resting on the sitting area. Further, the hollow body may provide dynamical seating characteristics in combination with the resilient and elastic properties and can in that way reduce at the same time tensions, pain states and nerval irritations in the area of the lumbar and dorsal vertebra and support the curing thereof.

Further, the hollow body according to the preferred embodiments is suitable for causing the user to move the dorsal vertebra in a compensating way, which increases the well-being and comfort during long persisting duration of seating and prevents effectively a tiredness.

Further, the deepening intended for the hollow body according to the preferred embodiments may be arranged between the legs of the U-like shaped, horseshoe-like shaped or tire-like shaped sitting area, respectively. This deepening shall be of sufficient depth in order to guarantee a suitable and advantageous relief of pressure of the pelvis bottom.

Alternatively, instead of the deepening the hollow body may have a recess or hole between the legs of the U-like shaped sitting area. The recess provides a continuous deepening of the height of the hollow body. In case of sufficient depth of the deepening or sufficient height of the hollow body, respectively, no pressure load will effect the areas of the pelvis bottom free of any sitting area. It results in the desired relief independent of the grade of the elastic distortion of the hollow body by the weight of the sitting person. The deepening or the recess is extended preferably over the complete spacious interior, respectively, comprised by the sitting area.

In a preferred embodiment, the hollow body has a supporting area, which e.g. is in contact with the sitting area of a chair arranged below. The supporting area is spaced from the sitting area by a distance. A front area of the sitting area is defined by the opening of the sitting area, i.e. preferably parts of the thighs are resting on the front area. Correspondingly, parts of the backside are resting on the rear area of the sitting area.

The hollow body or the parts, respectively, forming the sitting area taper advantageously in the thickness or size leading off from the rear area towards the front area.

Preferably, the hollow body according to the preferred embodiments has a substantially wedge-shaped profile in a longitudinal section. The outstanding feature of this wedge-shaped profile is substantially uniform tapering of the height of the hollow body. Alternatively, the sitting area and the supporting area may be spaced constantly, i.e. these both areas substantially run parallel in the section.

In a further preferred embodiment the outer outline of the hollow body exhibits a contour in a top view which can partially be fitted to a substantially elliptical or circular circumference. That is, the sitting area of the hollow body may be described as a substantially elliptical or circular sitting area, which has a deepening or recess, respectively, such that an overall U-like shaped or horseshoe-like shaped sitting area is formed.

Advantageously, the substantially elliptical or circular contour may have a diameter in the range of 30 cm to 50 cm.

Further advantageously, the deepening may have substantially a width in the range of 20 mm to 150 mm. Correspondingly, an alternative recess may advantageously also have substantially a width in the range of 20 mm to 150 mm.

The supporting area of the hollow body according to the preferred embodiments, which is in contact with a support, e.g. sitting area of a chair, may have a reinforcement structure of the supporting are in order to offer an additional protection against damage of the supporting area or in order to have a shape stabilizing effect on the U-like shaped sitting area, respectively. The reinforcement of the supporting area may be formed continuously in the area of a recess. A reinforcement in the area of the recess is advantageous, in order to prevent a diverging of the legs of the U-like shaped sitting area. The diverging of these legs may occur especially when using elastic materials, which are loaded by the weight of the person sitting thereon.

In a further preferred embodiment the surface of the hollow body is formed in predetermined areas in a nonskid way. The nonskidding is of interest in areas of the supporting area as well as in areas of the sitting area, e.g. so as to preclude a potential risk of injuring because of skidding of the hollow body according to the preferred embodiment. Nonskidding may be ensured e.g. by specific surface materials or e.g. by structuring of the surface.

Further advantageously, predetermined areas of the surface may have projecting bulges, rips or webs. These bulges may serve for the aforementioned nonskidding but also have a shape-stabilizing effect as well as they can give an optically attractive design to the hollow body. The bulges may have e.g. a substantially circular base area, advantageously with a diameter in the range of 0.01 cm to 1 cm or e.g. a lamella-like structure, advantageously with a width in the range of 0.01 cm to 1 cm.

In a preferred embodiment, the seat formed as a hollow body is fluid or solid-matter filled. Preferably, air or a liquid such as water may be used as fluid. Further, a viscous liquid such as a gel is considerable as fluid filing, which takes a damping effect on movements of the person seating on the seat. An elastic ductile filling material may be used as solid-matter. Among other things plastic foams are used for having different resilient characteristics.

Preferably, the hollow body envelopes the filling fluid, gel or the filling solid-matter in one or several internal chambers. These filling chambers may be self-contained to each other or may have defined ducts. In case of fluid-filling of the hollow body defined ducts are opposed to movements of the fluid.

Further preferably, the filling chambers are formed in the area of the portions or forms them. By this, a bi- or multi-chambered hollow body may be formed, respectively, the sitting area of which is divided into portions each of them forming by its own filling chamber.

In another embodiment the connecting web is formed hollow-shaped, such that it forms an internal channel, which is suitable for exchanging of air or fluid between the individual portions of the hollow body, respectively. For this purpose, the hollow-shaped connecting web opens at both ends into the spacious interior of the corresponding parts of the hollow body, connecting it.

In a further embodiment, the hollow-shaped connecting web is used with a hollow body having several filling chambers and preferably connects at least two of these chambers. By this, air or fluid can be moved between the chambers, respectively, such that the filling ratio of the individual chambers may be changed at wish of the user.

Advantageously, the skin of the hollow body is made of polymer, particularly the skin of the hollow body may contain softened polyvinyl chloride (PVC). The wall thickness of the skin of the hollow body has preferably a thickness in the range of 1 mm to 8 mm.

In a preferred embodiment the hollow body according to the preferred embodiments has a base area spaced form the sitting area. The surrounding peripheries of the sitting area and the base area are connected via a transition area, which extends continuously between the peripheries. The transition area is formed such that it supports the shape and from the U-like shaped sitting area in a stabilizing way.

Preferably, the transition area can have in its cross section a substantially semi-circular or semi-elliptic cross section. Further, the transition area can have in its cross section a total cross section composed of one or several substantially semi-circular or semi-elliptic cross portions.

Further objects, advantages and features of the preferred embodiments will become clear from the following exemplary description of preferred embodiments, with reference to the accompanying drawings.

DETAILED DESCRIPTION OF EMBODIMENTS SHOWN IN THE DRAWINGS

Figure 1A:
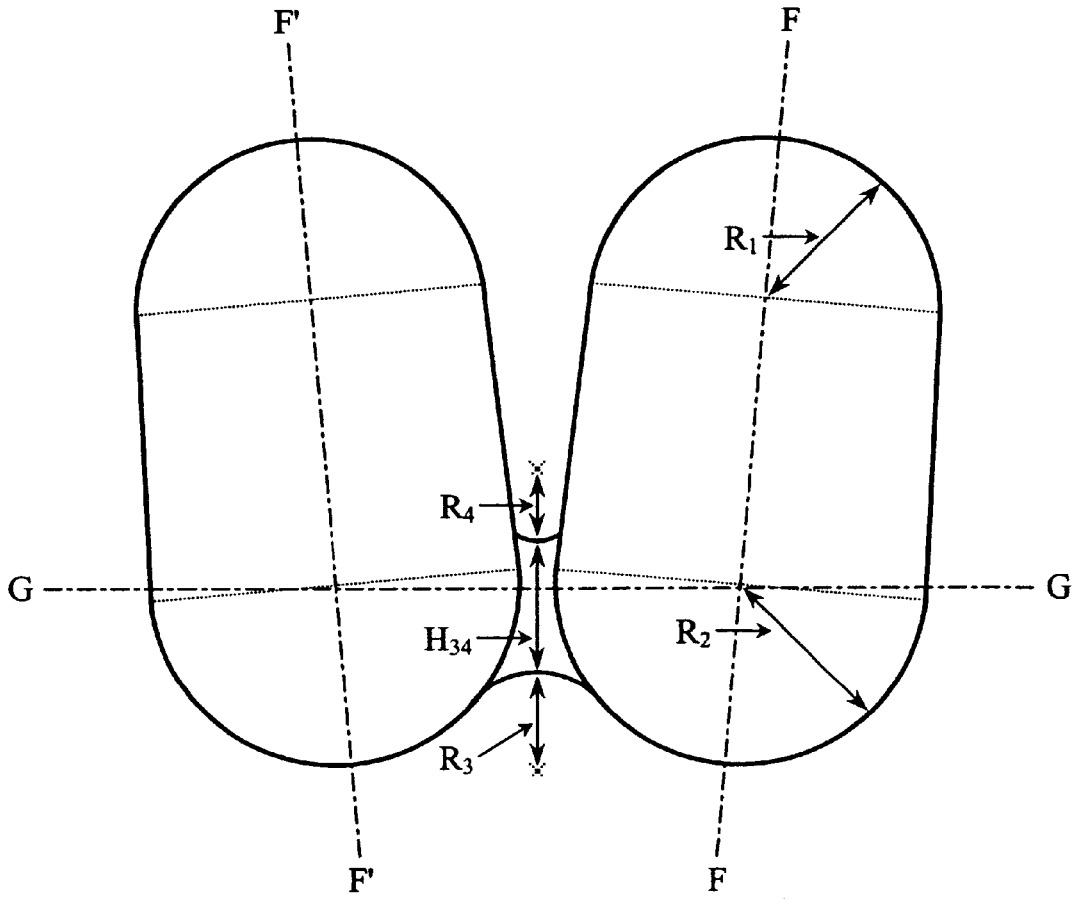
FIG. 1*a* is a top view of a first embodiment of the hollow body.

Reference to equal or similar elements of the figures is made using the same reference numerals.

Figure 1B:
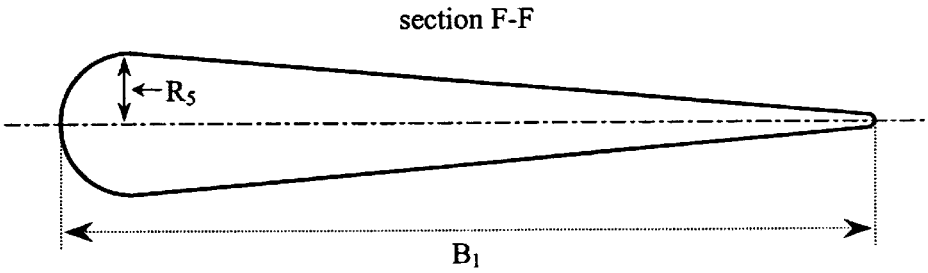
FIG. 1*b* is a cross section along the line F—F of FIG. 1.

A hollow body according to the invention is shown in FIG. 1 having two spaced portions forming the sitting area, which are joint together at the ends by a hollow-like shaped connecting web. The longitudinal middle axis (F, F') of the portions has a length of approximately 10 to approximately 40 cm, wherein a range of approximately 10–30 cm is preferred. The length of the middle axis is shown in FIG. 1*b* as the measure $B_1$. The transverse axis of the portions has a dimension of approximately 10–25 cm, preferably approximately 13–20 cm.

The connecting web has approximately $H_{34}$=3–10 cm length, preferably approximately $H_{34}$=5–7 cm, whereas its dimension of width increases because of the diverging portions from approximately 1 cm to approximately 8 cm, preferably from approximately 1 cm to approximately 7 cm.

The radius $R_1$ of the rounded front sections of each of the two spaced portions forming the sitting area has a dimension of approximately 5–10 cm, preferably approximately 6–9 cm. The radius $R_2$ of the rounded rear sections of each of the two spaced portions forming the sitting area has approximately 5–14 cm, preferably approximately 7–11 cm in length. The connecting web has rounded recesses shown in the top view of FIG. 1*a*. These rounded recesses have a radius $R_3$ of approximately 2–8 cm, preferably approximately 3–5 cm dimension, and a radius $R_4$ of approximately 1–5 cm, preferably approximately 2–3 cm dimension.

The both portions shown are formed by two filling chambers, which are joint together by the hollow-like shaped connecting web and by this they are in communication such that air or fluid can flow from the one chamber to the other chamber. That way the filling ratio of the cambers can be adjusted by the user.

The middle axis of the portions form an apical angle of approximately 1 to 15° relative to each other.

As shown in FIG. 1*b*, the cross section along the axis F—F illustrates the decrease of the height of the spaced portions forming the sitting area from the rear portion towards the front portion. The rear height of the portions forming the sitting area has approximately 2–8 cm, preferably approximately 2–6 cm. The front height area has approximately 1–5 cm, preferably approximately 2–4 cm. The transition area connecting the sitting area and the supporting area is substantially circular shaped and has—in the rear portion of the spaced portions forming the sitting area—a radius $R_5$ of approximately 1–8 cm, preferably approximately 2–4 cm. Correspondingly, the radius of the circular shaped transition area tapers towards the front portion to approximately 0.5–6 cm, preferably approximately 0.5–3 cm.

Figure 1C:
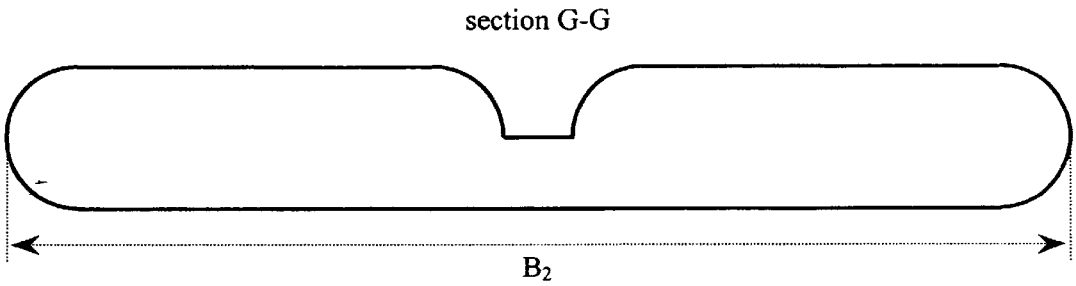
FIG. 1*c* is a cross section along the line G—G of FIG. 1.

As shown in FIG. 1*c*, the connecting web does occupy the total height of the hollow body, but is deepened compared with the parts of the hollow body forming portions. The total width of the section shown in FIG. 1*c* is approximately 21–60 cm, preferably approximately 30–50 cm.

Figure 2A:
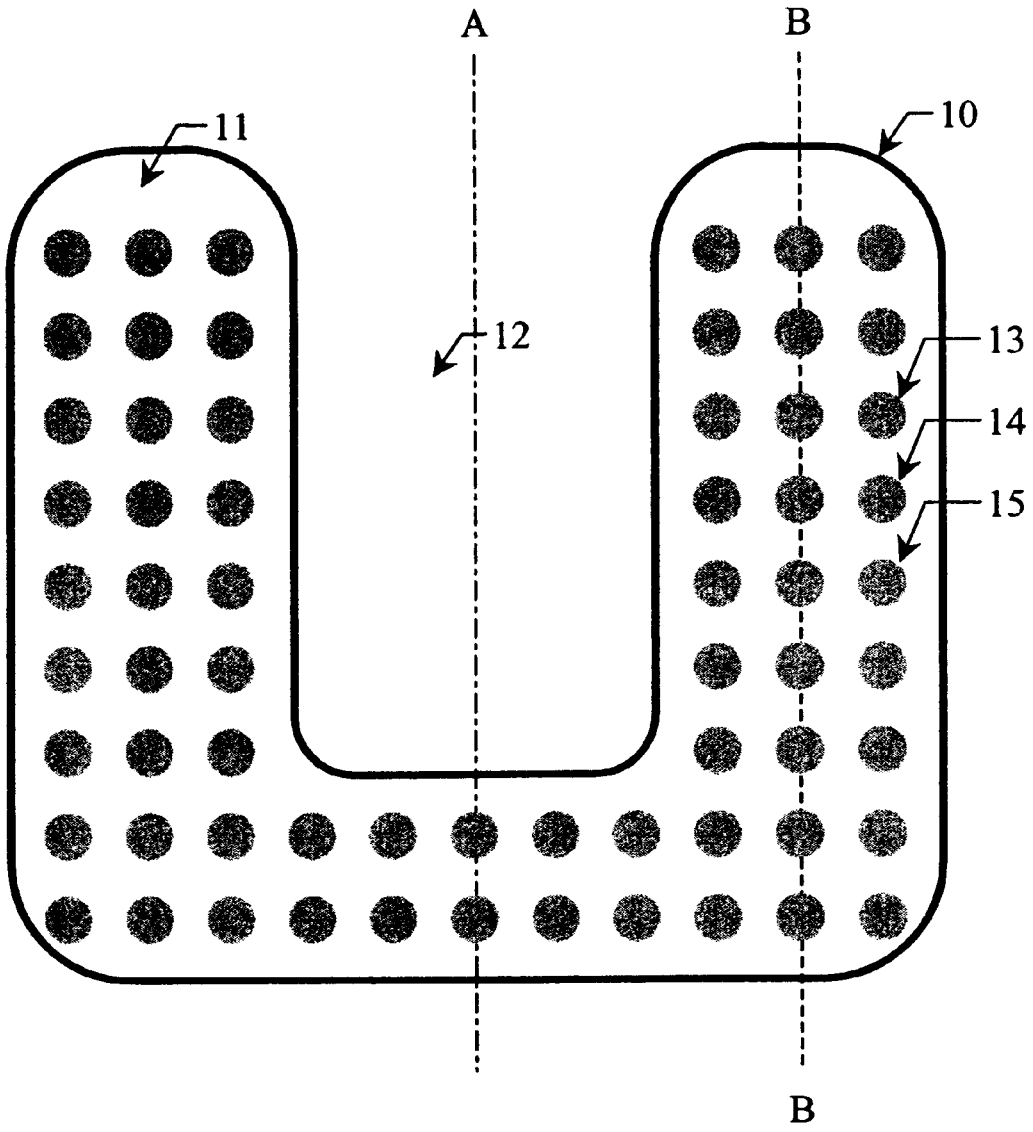
FIG. 2*a* is a top view of a second embodiment of the hollow body.

FIG. 2*a* is a top view of an embodiment of the hollow body according to the present invention. The hollow body 10 illustrated in FIG. 2*a* in a top view has a substantially rectangular outer shape and surface. The sitting area 11 is shown in the top view. In order to obtain a U-like shaped total shape of the hollow body 10 the recess 12 is incorporated into the hollow body. The hollow body 10 or the sitting area 11, respectively, is mirror symmetrical to the axis A or to a plane, respectively, perpendicular to the sitting area and which contains the axis A. In this embodiment, circular bulges 13, 14 and 15 are arranged on the sitting area 11. Preferably, the circular bulges 13, 14 and 15 are identical bulges, which serve the esthetic design and the nonskidding effect of the hollow body as well as for example a certain massage function.

The resilience of the hollow body 10 ensures that the sitting area 11 fits to the load by a person with respect to the anatomy of the part of the hollow body being in contact. Advantageously, the hollow body 10 is designed as a hollow body, the skin of the hollow body of which preferably being made of polymer, especially of softened polyvinyl chloride (PVC). In case of filling of such a hollow body with air a hollow body with the described elastic characteristics is obtained. Further, the adjustment of the air pressure in the spacious interior of the hollow body may be employed to control the outer shaping and to adjust the grade of distortion in response to external pressures to the requirements.

Figure 2B:
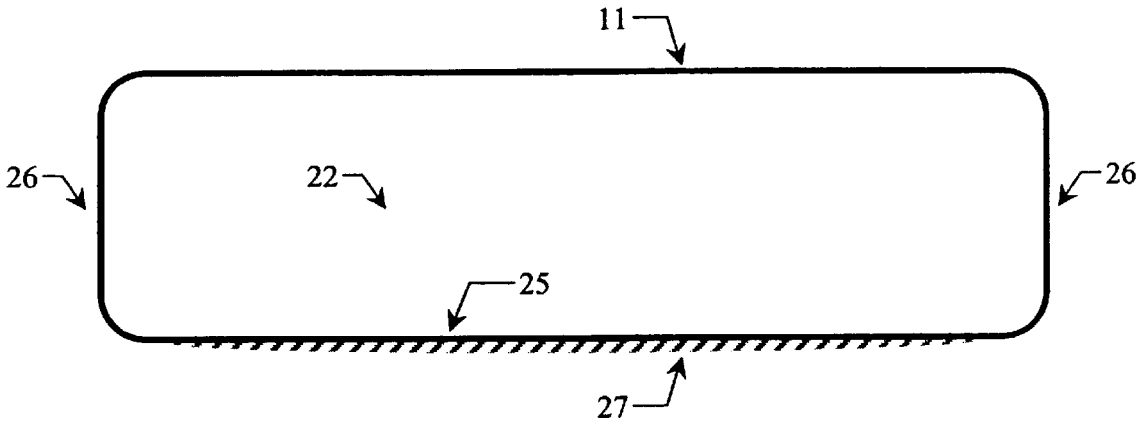
FIG. 2*b* is a sectional view along the line B—B in FIG. 2*a* of an embodiment according o the invention.

FIG. 2*b* is a sectional view along the line B—B in FIG. 2*a* of an embodiment according to the invention. The sectional view is chosen parallel to the axis of symmetry A to illustrate a substantially rectangular design along sectional views parallel to the line of symmetry A.

In the illustrated longitudinal section a section through the sitting area 11, the supporting area 25 as well as the transition area 26 is shown. The transition area connects the peripheries of the sitting area and of the supporting area of the hollow body in a surrounding way. The substantially rectangular shaping of the sectional view and thus also of the lateral profile shows a constant spacing of the sitting area from the supporting area, that is that the sitting area and the supporting area are substantially aligned parallel to each other.

Advantageously, the hollow body shown in FIG. 2*b* may be composed of two components, a first component comprising the sitting area and a part of the transition area and a second component comprising the supporting area and a further part of the transition area. In case that the both components are made of polymer the two components e.g. may be welded together.

Preferably, the spacious interior 22 of the hollow body is filled with a fluid, such as air or water. Further advantageously, the supporting area is formed to be nonskid. A structuring 27 of the supporting area 25 illustrated in FIG. 27 may be employed therefor. The structuring 27 may show a lamella-structure.

In a modified embodiment, the design of the transition area 26 may have a single or multi bulge-like, semi-elliptic, semi-circular or the like shaping instead of the wall-like shaping.

Figure 2C:
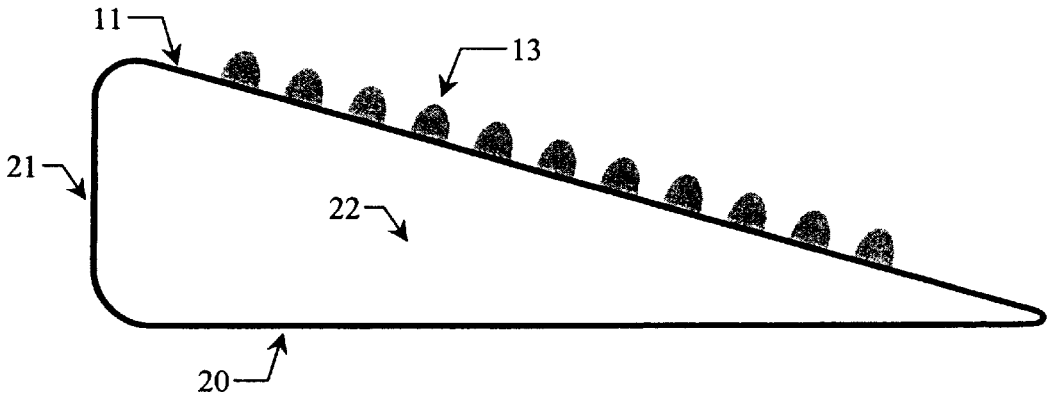
FIG. 2*c* is a sectional view along the line B—B in FIG. 2*a* of a further embodiment according o the invention.

FIG. 2*c* is a sectional view along the line B—B in FIG. 2*a* of a further embodiment according to the invention. The sectional view is chosen parallel to the axis of symmetry A in order to illustrate the advantageous wedge-shaped design along sectional views parallel to the axis of symmetry A.

A section through the sitting area 11 and exemplary a bulge 13 is to be seen in the illustrated longitudinal section. Further, portions through the supporting area 20 and the transition area 21 are illustrated. Preferably, the spacious interior 22 is filled with air. Alternatively, comparable elastic characteristics are to be obtained with a plastic foam like filling of the hollow body. In case of filling the hollow body with a liquid elastic characteristics of the hollow body are obtained by corresponding material selection of the skin of the hollow body, since liquids do not show any elastic characteristics itself.

The illustrated longitudinal section shows a wedge-shaped profile. This profile is obtained in each section parallel to the axis of symmetry A illustrated in FIG. 1.

Correspondingly, this profile appears also in a side view of the hollow body 10. The illustrated wedge-shaped profile of the hollow body 10 in the longitudinal view shows a profile pointed towards the front, such that in this periphery the sitting area merges straightly with the supporting area. In a modified embodiment, a bulge-like shape of the wall-like shaped transition area may connect the sitting area and the supporting area in the front area.

Figure 3:
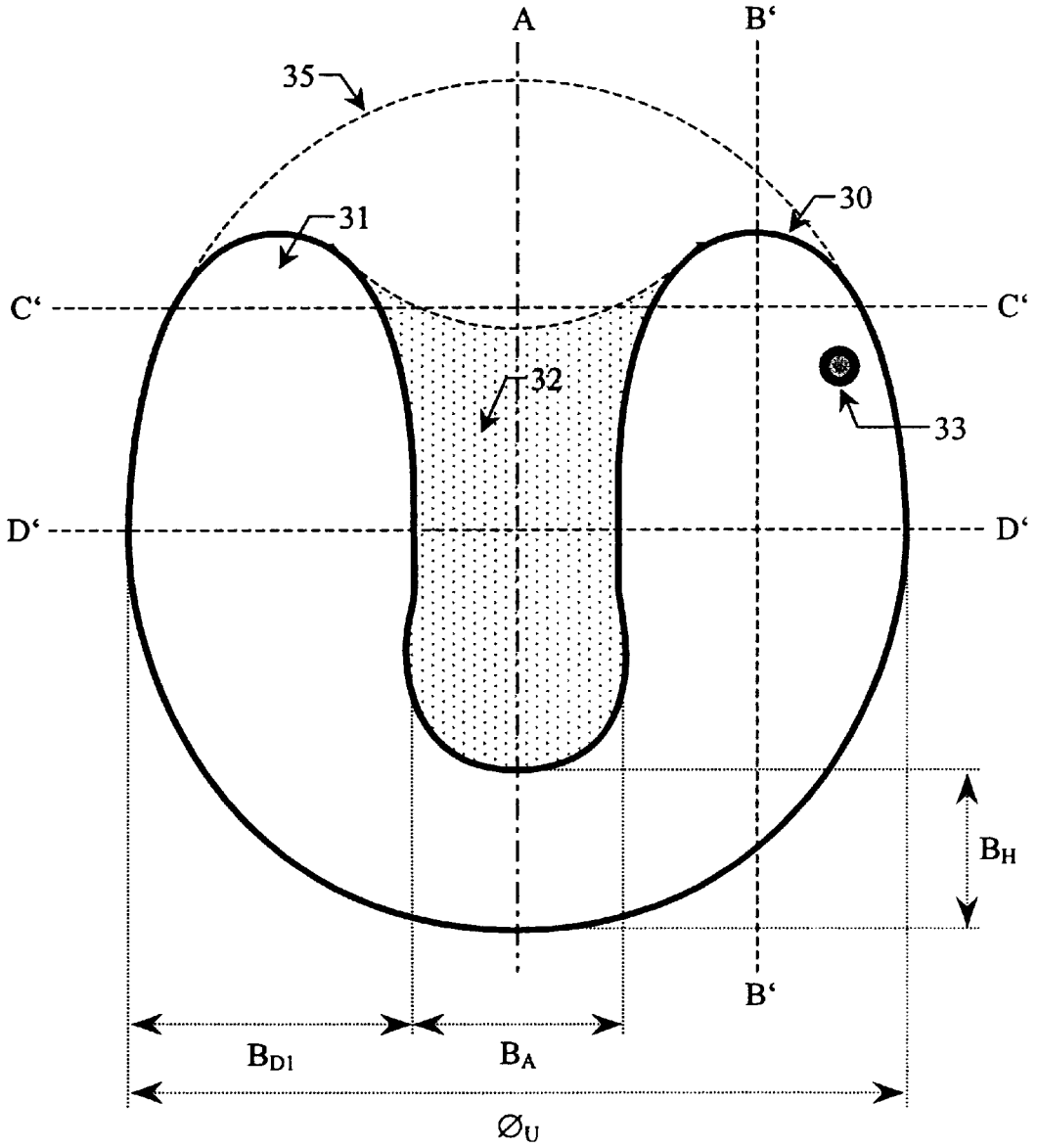
FIG. 3 is a top view of a further embodiment of the hollow body according to the present invention.

FIG. 3 is a top view of a further embodiment of the hollow body according to the present invention. The embodiment illustrated here shows a substantially elliptic outer shape or outline 35 of the hollow body in the top view. The contour 35 is to be recognized for clarified illustration in a dashed styling in FIG. 3. The sitting area of the hollow body 30 is formed U-like shaped and correspondingly the sitting area 31 is shown again in the top view. The U-like shaped sitting area 31 and the hollow body 30 having a substantially elliptic outline 35 are mirror symmetrical to the axis A'. The spacious interior 32 comprised partially by the U-like shaped sitting area 31 shows a recess having a continuous base reinforcement 32. Alternatively, instead of the recess a deepening may be incorporated at this position into the hollow body. The base reinforcement shown here protects the supporting area, may have a specific skid reducing coating on the supporting side and stabilizes the legs of the U-like shaped sitting area against a deformation movement towards the side.

Preferably, the diameter $Ø_S$ of the hollow body 30 is in a range of 30 cm to 40 cm. Advantageously, the width $B_A$ of the recess or the deepening is in a range of 20 mm to 150 mm, respectively. Correspondingly, a substantially mean width of the legs of the U-like shaped sitting area results from these quantities in 75 mm to 175 mm. Further advantageously, the depth $B_H$ of the base area of the U-like shaped sitting area has a depth in a range of 70 mm to 80 mm.

In order to fill the hollow body 30 designed as a hollow body with fluids, advantageously a corresponding inlet 33 is incorporated in the skin of the hollow body. This inlet 33 may be a valve. The valve may be employable for single or multiple use. In case of single use the hollow body is filled once with a pre-defined amount or with a pre-defined volume of fluid, respectively, and the inlet 33 is closed irreversibly. An inlet 33 prepared for multiple use allows a user to adapt the mount of filling or the volume of filling individually e.g. to his weight, respectively, in order to obtain optimal characteristics of the hollow body 30.

Figure 4A:
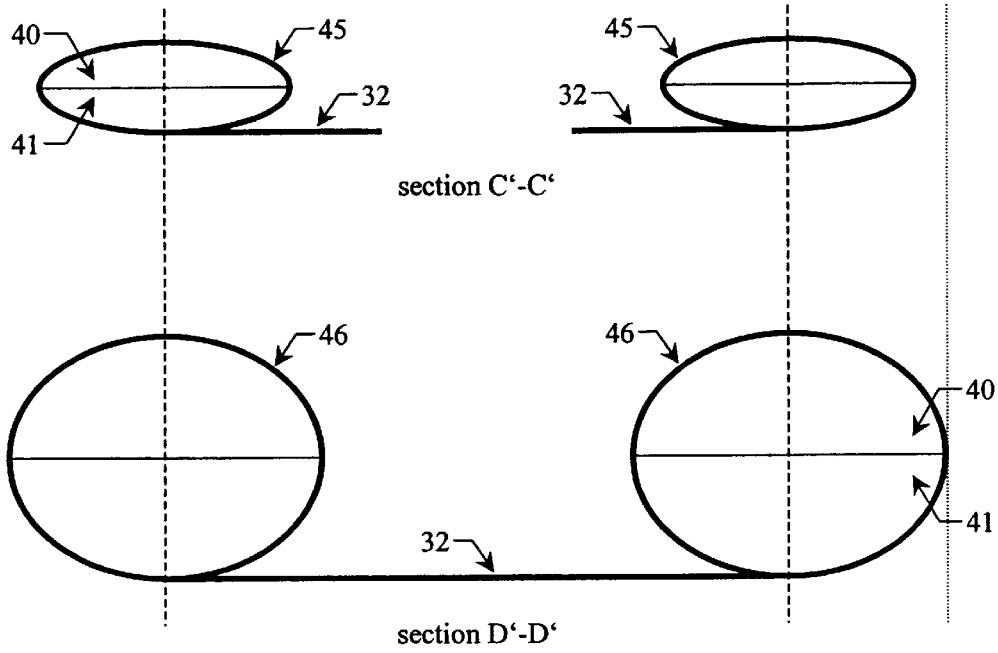
FIG. 4*a* are sectional views along the lines C'—C' and D'—D' in FIG. 3 of an embodiment of the invention.
Figure 4B:
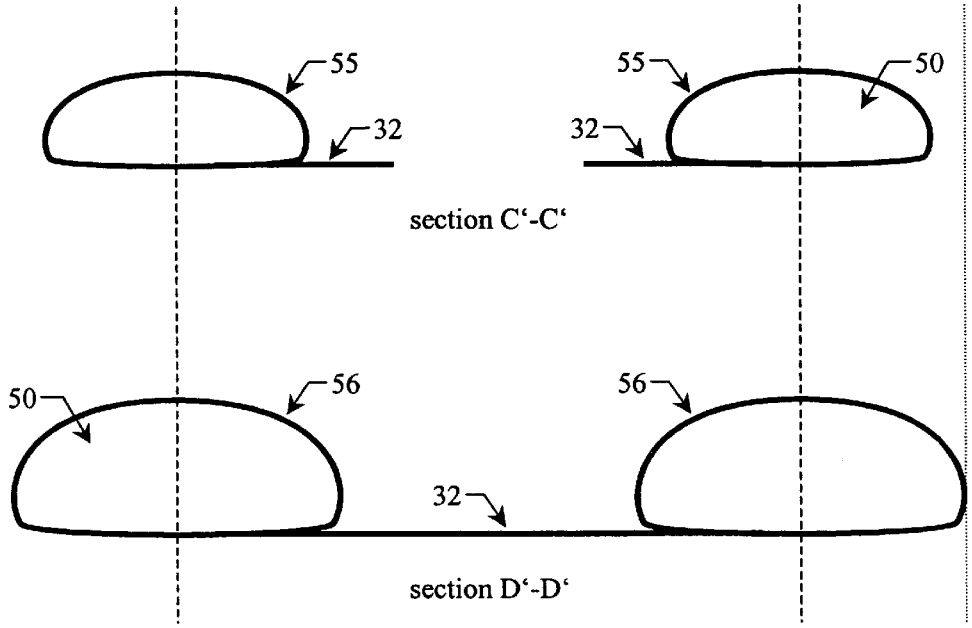
FIG. 4*b* are sectional views along the lines C'—C' and D'—D' in FIG. 3 of a further embodiment of the invention.
Figure 4C:
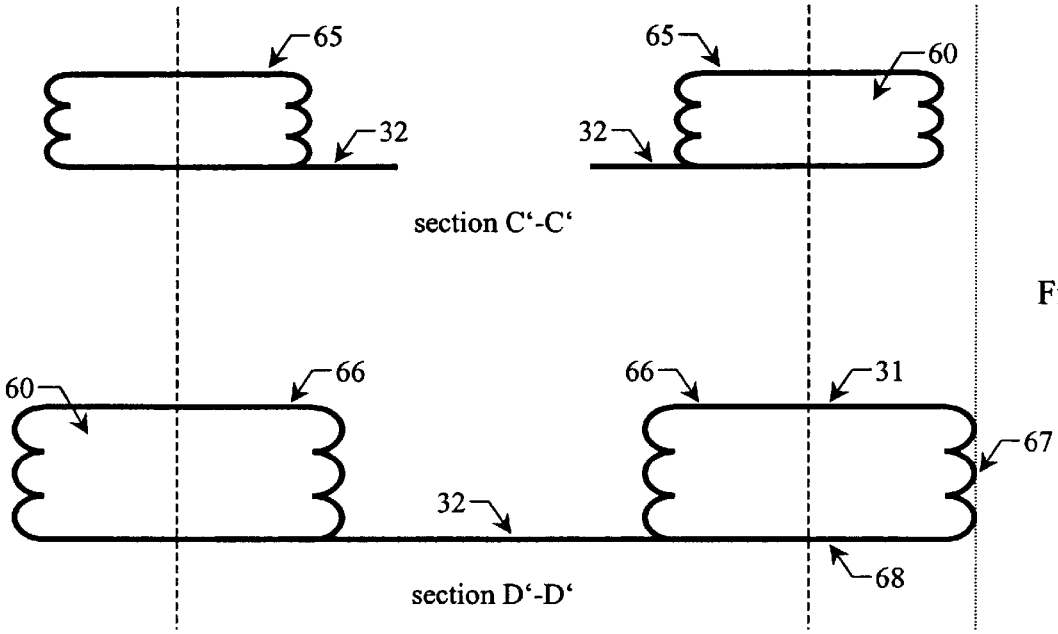
FIG. 4*c* are sectional views along the lines C'—C' and D'—D' in FIG. 3 of a further embodiment of the invention.

FIG. 4*a,* FIG. 4*b* and FIG. 4*c* show sectional views along the lines C'—C' and D'—D' in FIG. 3 of different embodiments according to the invention.

In FIG. 4*a* are illustrated the cross portions of a first embodiment along the sectional line C'–C" and D'—D' of a substantially elliptical tube-like shaped hollow body 30. The cross portions 45 compared with the cross section 46 are reduced in size corresponding to the tapered side view and the tapered legs of the U-like shaped sitting area in FIG. 3. The transition from the sitting area 31 to the transition area of the side and the supporting are is continuously. Corresponding to the withdrawn reinforcement 32 shown in FIG. 3 this is not shown continuously in the section C'. Preferably, the hollow body shown in FIG. 4*a* is a hollow body having two filling chambers 40 and 41.

In FIG. 4*b* are illustrated the cross portions of a further embodiment along the sectional lines C'—C' and D'—D' of a substantially flattened elliptic tube-like shaped hollow body 30. The cross portions 55 compared with the cross section 56 are reduced in size corresponding to the tapered side view and the tapered legs of the U-shaped sitting area in FIG. 3. The transition from the sitting area 31 to the transition areas of the side and the supporting area is continuously. Corresponding to the withdrawn reinforcement 32 shown in FIG. 3 this is not shown continuously in section C'. Preferably, the hollow body shown in FIG. 4*b* is a hollow body having one filling chamber 50.

In FIG. 4*c* are illustrated the cross portions in a further embodiments along the sectional lines C'—C' and D'—D' of a substantially rectangular shaped hollow body 30 having a multiple bulging transition area 67. The cross portions 65 compared with the cross section 66 are reduced in size corresponding to the tapered side view and the tapered legs of the U-like shaped sitting area in FIG. 3. The cross portions include the sitting area 31, the transition area 67 of the side and a supporting area 68, shown exemplary only in a cross section 66. Corresponding to the withdrawn reinforcement 32 shown in FIG. 3 this is not shown continuously in the section C'. The reinforcement 32 turns continuously into the supporting area 68 but can also strengthen additionally the supporting area 68 (not shown). Preferably, the hollow body 30 shown in FIG. 4*c* is a hollow body having one filling chamber 60.

Figure 5A:
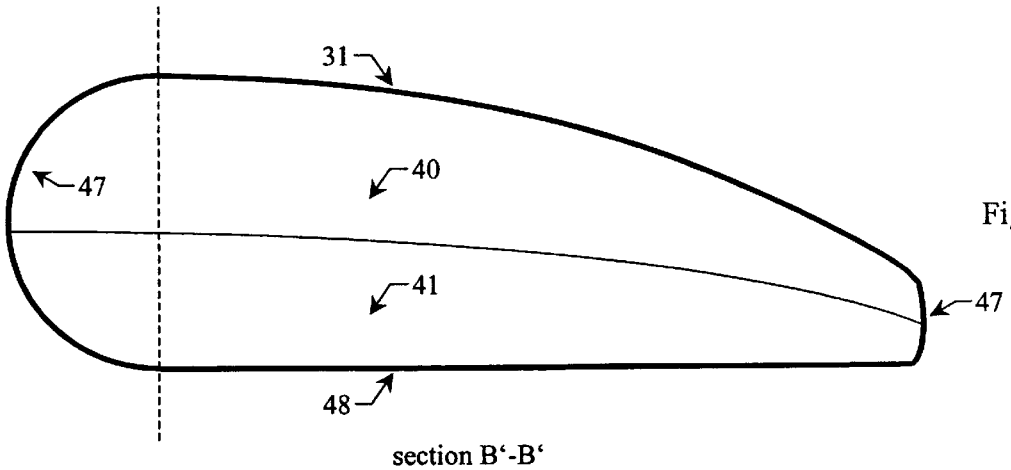
FIG. 5*a* is a sectional view along the line B'—B' in FIG. 3 of an embodiment according to the invention.
Figure 5B:
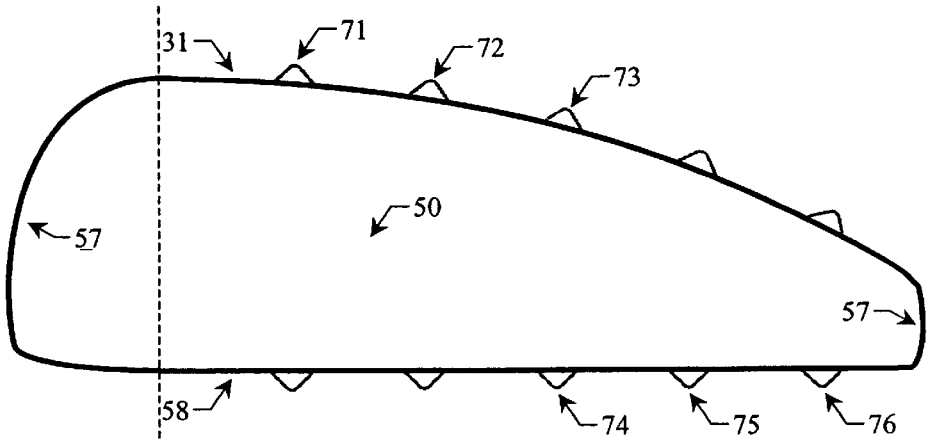
FIG. 5*b* is a sectional view along the line B'—B' in FIG. 3 of a further embodiment according to the invention.
Figure 5C:
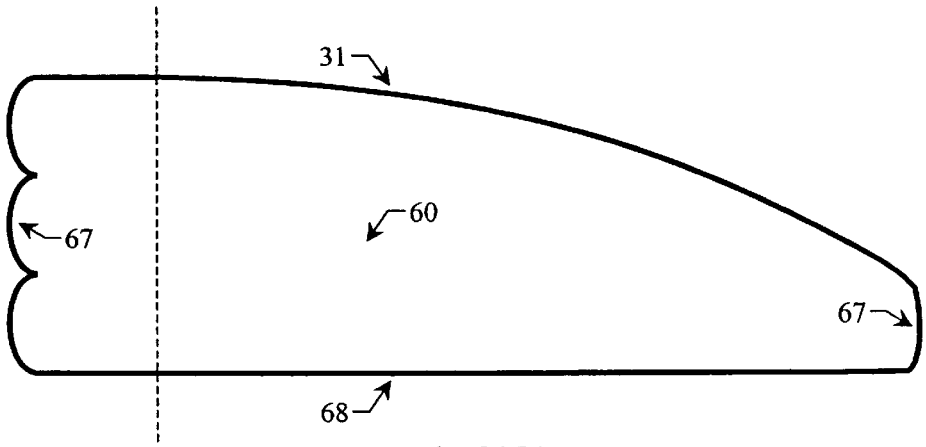
FIG. 5*c* is a sectional view along the line B'—B' in FIG. 3 of a further embodiment according to the invention.

FIG. 5*a,* FIG. 5*b* and FIG. 5*c* show sectional views along the line B'—B' in FIG. 3 of different embodiments according to the invention.

The sectional view in FIG. 5*a* shows a longitudinal section through an embodiment of the hollow body 30 of which cross portions are illustrated in FIG. 4*a*. Correspondingly, in the following description references will made to the reference numerals of FIG. 3 and FIG. 4*a*. The cross section includes the sitting area 31, the supporting area 48 as well as the transition area 47 of the hollow body 30. The both air chambers 40 and 41 divide internally the hollow body 30 designed as a hollow body. The hollow body 30 is tapered towards the opening of the U-like shaped sitting area.

The sectional view in FIG. 5*b* shows a longitudinal section through an embodiment of the hollow body 30 of which cross portions are illustrated in FIG. 4*b*. Correspondingly, in the following description references will made to the reference numerals of FIG. 3 and FIG. 4*b*. The cross section includes the sitting area 31, the supporting area 58 as well as the transition area 57 of the hollow body 30. The hollow body 30 designed as a hollow body has a filling chamber 50. The hollow body 30is tapered towards the opening of the U-like shaped sitting area. The sitting area 31 as well as the supporting area 58 have additionally bulges 71, 72 and 73 or bulges 74, 75 and 76, respectively. Preferably, the bulges are shaped identically.

The sectional view in FIG. 5*c* shows a longitudinal section through an embodiment of the hollow body 30 of which cross portions are illustrated in FIG. 4*c*. Correspondingly, in the following description references will made to the reference numerals of FIG. 3 and FIG. 4*c*. The cross section includes the sitting area 31, the supporting area 68 as well as the transition area 67 of the hollow body 30. The hollow body 30 designed as a hollow body has a filling chamber 60. The hollow body 30 tapers towards the opening of the U-like shaped sitting area.

What is claimed is:

1. A hollow body for use as a sitting support, comprising:

a sitting area, the sitting area including at least two portions spaced from each other;

at least one integral central recessed area formed between the two portions, which lessens pressure on the pelvis of a user when sitting on the hollow body, the two portions being interconnected by at least one connecting web extending between the two portions;

a supporting area spaced from the sitting area, the supporting area and the sitting area including surfaces which are tapered relative to each other so that the sitting area at a back portion of the hollow body is spaced farther from the supporting area than at a front portion of the hollow body; and at least one filling chamber in each of the two portions of the hollow body for receiving a selectable volume of fluid to fill the hollow body to provide a selectable sitting support.

2. A hollow body according to claim 1, wherein the connecting web and the two portions are integrally formed as one-piece.

3. A hollow body according to claim 1, wherein the at least one integral central recessed area opens outwardly.

4. A hollow body according to claim 1, wherein the hollow body comprises a geometry selected from the group consisting of: U-shapes, horseshoe-shapes or circular shapes and the sitting area reacts resiliently to a load acting on the sitting area.

5. A hollow body according to claim 1, wherein the hollow body is made at least partially of a thermoplastic polymer.

6. A hollow body according to claim 5, wherein the two portions include middle axes forming an apical angle.

7. A hollow body according to claim 5, wherein the central recessed area is encircled at least partially by a U or a horseshoe-shaped sitting area.

8. A hollow body according to claim 5, wherein the at least one integral central recessed area is defined and terminated by the two portions and the connecting web.

9. A hollow body according claim 5, wherein the taper between the supporting area and the sitting area defines a wedge.

10. A hollow body according to claim 5, wherein an outer shape of the hollow body has at least partially a substantially elliptical or circular segmented shape.

11. A hollow body according to claim 5, wherein an outline of the hollow body has a diameter in range of 30 cm to 50 cm.

12. A hollow body according to claim 5, wherein the at least one integral central recessed area has a width in the range of 20 mm to 150 mm.

13. A hollow body according to claim 5, wherein the supporting area has a base reinforcement.

14. A hollow body according to claim 13, wherein the base reinforcement is continued into the at least one integral central recessed area.

15. A hollow body according to claim 5, wherein an outer surface of the hollow body has a nonskid surface composition in pre-determined areas of the sitting area.

16. A hollow body according to claim 5, wherein a surface of the hollow body includes projecting bulges.

17. A hollow body according to claim 16, wherein the bulges dimensionally range from 0.01 cm to 1 cm.

18. A hollow body according to claim 5, wherein the fluid is a liquid.

19. A hollow body according to claim 5, wherein the fluid is air.

20. A hollow body according to claim 5, wherein the connecting web is hollow.

21. A hollow body according to claim 5, wherein the thermoplastic polymer is polyvinyl chloride (PVC).

22. A hollow body according to claim 14, wherein the hollow body includes an outer layer with a wall thickness ranging from 1 mm to 8 mm.

23. A hollow body according to claim 14, comprising a transition area between the sitting area and the supporting area which extends continuously between and connects surrounding peripheries of the supporting area and the sitting area.

24. A hollow body according to claim 23, wherein a cross section of the transition area is substantially rounded or semi-elliptical.

25. A hollow body according to claim 23, wherein the transition area comprises substantially rounded or semi-elliptical individual cross sectional portions.

* * * * *